US006609983B2

(12) United States Patent
Winfield

(10) Patent No.: US 6,609,983 B2
(45) Date of Patent: Aug. 26, 2003

(54) DIMPLE PATTERN ON GOLF BALLS

(75) Inventor: Douglas C. Winfield, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/800,454

(22) Filed: Mar. 5, 2001

(65) Prior Publication Data

US 2002/0165043 A1 Nov. 7, 2002

(51) Int. Cl.[7] ..... A63B 37/12
(52) U.S. Cl. ..... 473/378
(58) Field of Search ..... 473/378–385; 156/146

(56) References Cited

U.S. PATENT DOCUMENTS

| | | | | |
|---|---|---|---|---|
| 4,915,389 A | | 4/1990 | Ihara | 273/232 |
| 4,991,852 A | | 2/1991 | Pattison | 273/232 |
| 5,123,652 A | * | 6/1992 | Oka | 473/384 |
| 5,145,180 A | * | 9/1992 | Oka | 473/382 |
| 5,201,522 A | | 4/1993 | Pocklington et al. | 273/232 |
| 5,564,708 A | * | 10/1996 | Hwang | 473/382 |
| 5,957,786 A | * | 9/1999 | Aoyama | 473/379 |
| 6,358,161 B1 | * | 3/2002 | Aoyama | 473/383 |

* cited by examiner

*Primary Examiner*—Mark S. Graham
*Assistant Examiner*—Raeann Gorden
(74) *Attorney, Agent, or Firm*—Swidler Berlin Shereff Friedman, LLP

(57) ABSTRACT

Golf balls are disclosed having novel dimple patterns determined by polyhedrons and intersecting great circles that connect points on the polyhedral segments. A method of packing dimples according to positions of the polyhedron and the intersecting great circles is also disclosed. For each disclosed dimple pattern, dimples of varying size are positioned along the edges of a polyhedron and then dimples of varying size are positioned where great circles that connect points on the edges of the polyhedral segments intersect. Any remaining space on the golf ball surface is filled with dimples. This results in a golf ball having a dimple pattern that has some uniformity but also some variance.

10 Claims, 2 Drawing Sheets

DIMPLE PATTERN ON GOLF BALLS

1. TECHNICAL FIELD OF THE INVENTION

Figure 1:
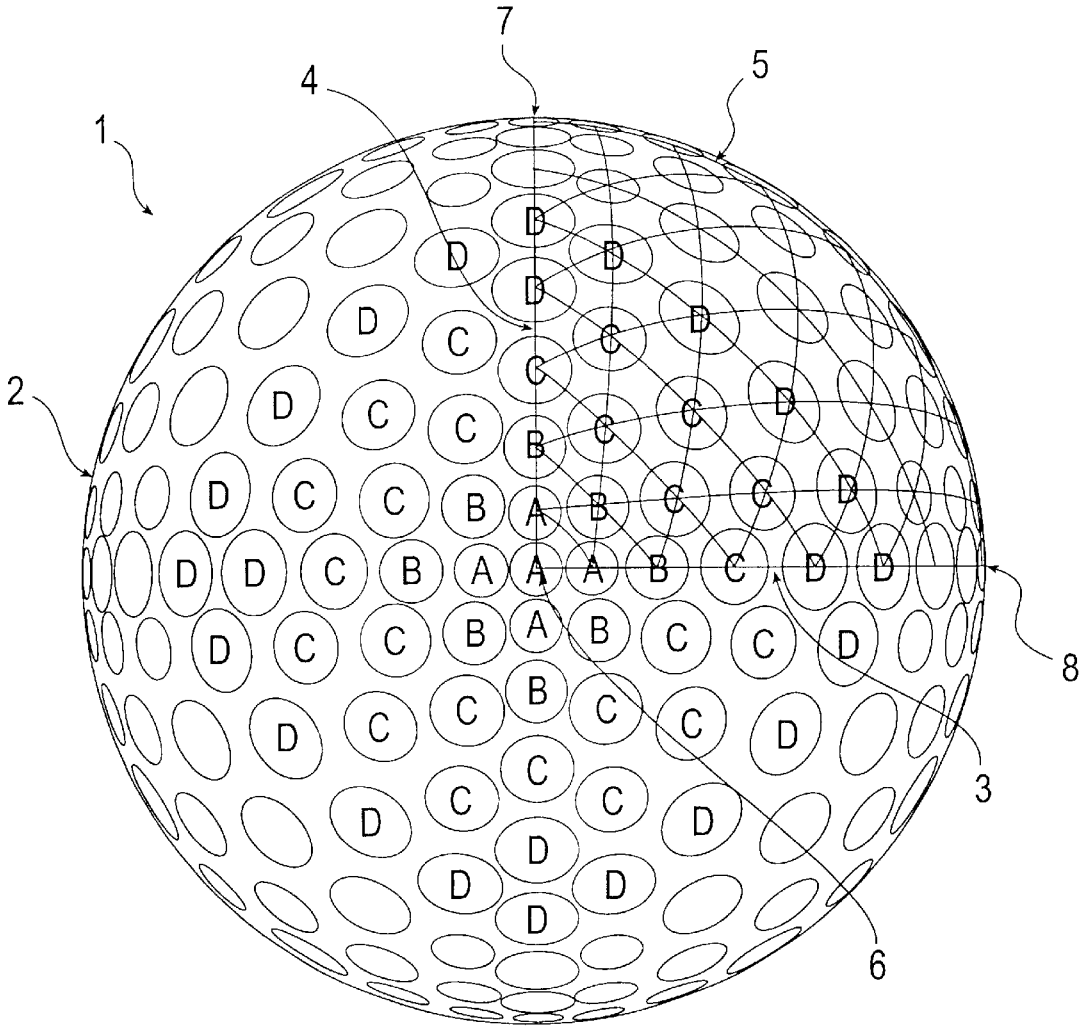

The present invention generally relates to golf balls, and more particularly, to a golf ball having improved dimple patterns.

2. BACKGROUND OF THE INVENTION

Golf balls were originally made with smooth outer surfaces. In the late nineteenth century, players observed that the guttie golf balls traveled further as they got older and more gouged up. The players then began to roughen the surface of new golf balls with a hammer to increase flight distance. Manufacturers soon caught on and began molding non-smooth outer surfaces on golf balls.

By the mid 1900's, almost every golf ball being made had 336 dimples arranged in an octahedral pattern. Generally, these balls had about 60% of their outer surface covered by dimples. In 1983, Titleist introduced the TITLEIST 384, which, not surprisingly, had 384 dimples that were arranged in an icosahedral pattern. About 76% of its outer surface was covered with dimples. Today's dimpled golf balls travel nearly two times farther than a similar ball without dimples.

The dimples on a golf ball are important in reducing drag and providing lift. Drag is the air resistance that acts on the golf ball in the opposite direction from the balls flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps the boundary layer stay attached to the golf ball's surface further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators. Most balls today still have many large spaces between dimples or have filled in these spaces with very small dimples that do not create enough turbulence at average golf ball velocities.

There are many patents directed to various dimple patterns. Some of these patents are based upon great circles, lines that extend along the surface of a sphere. U.S. Pat. No. 4,915,389 discloses a dimple pattern with dimples on the great circle of the equator. However, the patent does not disclose a dimple pattern where a number of dimples are positioned along edges of a polyhedral shape and the remaining dimples are positioned where great circles between the dimples on the edges of the polyhedral shape intersect.

U.S. Pat. No. 4,991,852 also discloses a dimple pattern where dimples are placed on great circles. Instead of using great circles of the equator, this patent discloses great circles that connect points on a golf ball that correspond to points on segments of a polyhedron, a three dimensional structure bounded by polyhedral segments that are formed by vertices and edges. The pattern is based upon a geodesic nine-frequency icosahedron, a specific three dimensional structure bounded by eight triangular polyhedral segments where each edge of the icosahedron is divided into nine parts with the division points connected by great circles to form a series of uniformly distributed intersecting vertices. The dimple pattern is generated when dimples of the same size are placed at the division points and at the vertices to cover a golf ball surface with 812 equally spaced small dimples. However, the patent does not disclose a dimple pattern for other polyhedron structures where the dimples on the edges or at the vertices vary in size.

U.S. Pat. No. 5,562,552 discloses a dimple pattern where dimples are placed on great circles. This pattern is based upon a geodesically expanded icosahedron where the surface of a golf ball intersects each vertex of the icosahedron. Each vertex of an icosahedron surface is connected to a geodesic focus point so that three right regular tetrahedra are formed for each icosahedron surface. Dimples are then placed so that each of the 60 triangles formed on the surface of the golf ball have the same or substantially the same dimple pattern. While it is disclosed that dimples may be placed at the focus point, along the edges of the 60 triangles, and between the edges of the 60 triangles, the patent does not disclose a series of great circles on the icosahedron and then positioning dimples where those great circles intersect.

There continues to be a need for dimple patterns that have a high percentage of dimple coverage. More particularly, there is a need for dimple patterns that do not have large spaces between the dimples. Additionally, there is a need for dimple patterns that do not fill in these spaces with very small dimples.

There also continues to be a need for dimple patterns that increase lift and drag. More particularly, there continues to be a need for dimple patterns that have the same lift and drag from all orientations.

3. SUMMARY OF THE INVENTION

The present invention provides a golf ball with an outer surface that has dimples positioned according to polyhedral structures that are not a geodesic nine-frequency icosahedron. Preferably, the dimples are positioned by initially placing dimples at the points of intersection of great circles that connect the edges of the polyhedral segments that make up each polyhedral structure.

The present invention also provides for a method of packing dimples of varying size and number on the outer surface of a golf ball according to polyhedral structures that are not a geodesic nine-frequency icosahedron.

The present invention includes a golf ball that has a dimple pattern based upon intersecting great circles between points on a polyhedron segment. In a first embodiment of the present invention, arrangement of the dimple pattern begins with the mapping of a polyhedron onto an outer surface of a golf ball. The present invention permits orientation of the polyhedron to be any where on the golf ball's outer surface. The present invention also permits orientation of the polyhedron according to a parting line, two hemispheres, or the two poles of the outer surface. The parting line is located at the equator of the outer surface, there by dividing the outer surface into the two hemispheres. Each hemisphere has a pole positioned at the furthest point on the outer surface from the parting line. Preferably, the structure of a polyhedral segment oriented according to a pole and the parting line of the outer surface and is made of a number of edges where each edge connects two vertices. Each point of the polyhedral segment, as well as each point on the golf ball surface, has a longitude, $\theta$, and a latitude, $\phi$, that defines its position. Great circles can be drawn to connect points from different edges or vertices of the polyhedron. Locations where great circles intersect can be determined mathematically. Where one great circle connects two points having $(\theta_1, \phi_1)$ and $(\theta_2,\phi_2)$ positions on the polyhedron and another great circle connects two different points having $(\theta_3,\phi_3)$ and $(\theta_4,\phi_4)$ positions on the polyhedron, the point, $(\theta,\phi)$, where these two great circles intersect on the polyhedron can be calculated by solving for $\theta$ and $\phi$ in the two equations shown of TABLE 1.

TABLE 1

$$\theta = \tan^{-1}[\sin(\theta_1)\sin(\theta_2)\sin(\phi_1 - \phi_2)]/[\cos(\theta_1)\sin(\theta_2)(\sin(\phi - \phi_2) - \sin(\theta_1)\cos(\theta_2)\sin(\phi - \phi_1)]$$
$$\theta = \tan^{-1}[\sin(\Theta_3)\sin(\theta_4)\sin(\phi_3 - \phi_4)]/[\cos(\theta_3)\sin(\theta_4)(\sin(\phi - \phi_4) - \sin(\theta_3)\cos(\theta_4)\sin(\phi - \phi_3)]$$

If great circles that originate from edges of a single polyhedron segment intersect within that polyhedron segment, dimples can be positioned at or near the points that are connected by each great circle and at or near the point where the great circles intersect. In certain areas of the golf ball around the point where great circles intersect the dimple coverage is sparse, a cluster of dimples can be positioned so that a larger portion of the surface area can be covered. For those portions of the outer surface that are not covered by dimples at intersections, various sized dimples can then be inserted.

In a simplified embodiment, an octahedral segment is mapped on the surface of a golf ball. A single point on each edge is selected and great circles are drawn between these points and between these points and the vertices. Dimples are then centered at or placed near these points, the vertices, and the points where the great circles intersect. This results in a octahedron segment that has ten dimples; three dimples on the vertices, three dimples at the selected point on the edges, and four dimples at the points where the great circles intersect.

The dimple patterns according to the present invention can provide a high percentage of coverage of the golf ball surface. Preferably, the total number of dimples is about 200 to about 700 and the dimples have a diameter of about 0.09 inches to 0.2 inches. More preferably, the dimples have a diameter of about 0.10 inches to 0.18 inches. The percentage of the golf ball surface covered by dimples ranges from about 65% to 90%. More preferably, the percentage of the golf ball surface covered by dimples is at least about 70%.

An embodiment of the present invention is an outer surface of a golf ball with 290 dimples. Preferably, the polyhedron used to position the dimples is an octahedron. The dimple pattern has dimples of a first, a second, a third, and a fourth size. Each edge of the octahedron has a number of dimples that may varying in diameter and depth. Great circles connect each dimple center point on each edge of the octahedral triangle with a corresponding point on each of the other two edges of the octahedral triangle. Dimples of varying size are then centrally positioned where the great circles intersect. This pattern results in greater than 60% of the golf ball surface being covered by dimples.

4. BRIEF DESCRIPTION OF THE DRAWINGS

Figure 2:
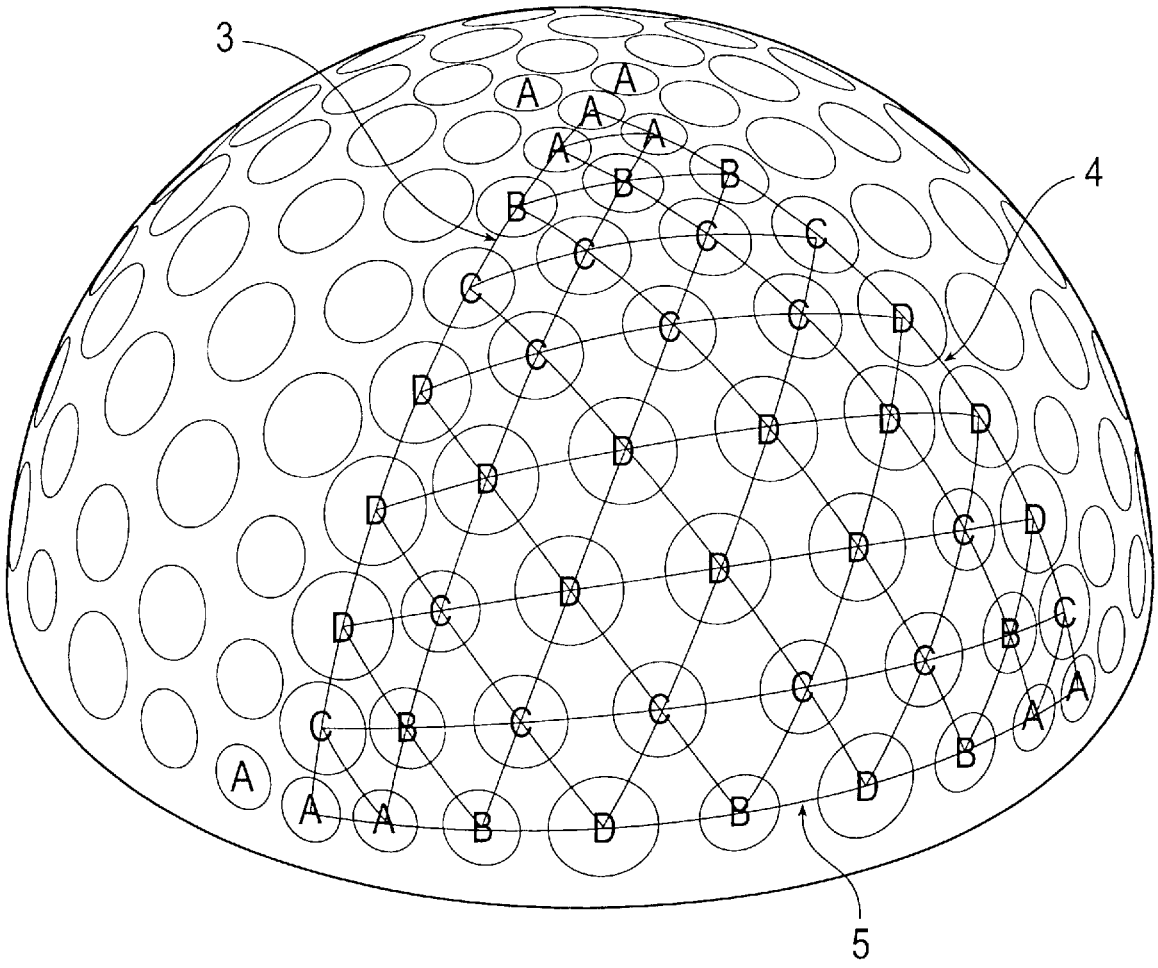

FIG. 1 is a pole view of the outer surface of a golf ball with a dimple pattern based upon intersecting great circles of a polyhedron; and FIG. 2 is a side view of a outer surface of a golf ball with a dimple pattern based upon intersecting great circles of an octahedron.

5. DETAILED DESCRIPTION

The following description of the preferred embodiments will be for the formation of dimple patterns on a first polyhedral segment. Although not discussed, the pattern is repeated on the other polyhedral segments. The polyhedral and great circles mentioned in this application have no physical manifestation upon the golf ball. Rather, they are only geometric guides for dimple placement.

FIG. 1 shows a hemisphere of a golf ball surface 1 with a dimple pattern corresponding to an embodiment of the claimed invention. In this embodiment, four different sized dimples, A–D, are used to create the octahedron dimple pattern. Dimple D has the largest diameter, dimple C has a diameter larger than dimples B and A, and dimple B has a greater diameter than dimple A. For dimple depth and diameter, U.S. Pat. No. 5,080,367 is incorporated by reference. The preferred dimple diameters for this embodiment are set forth in Table 1.

TABLE 2

| Dimple | Diameter (inches) |
|---|---|
| A | 0.10 |
| B | 0.12 |
| C | 0.14 |
| D | 0.16 |

The pattern for placement of the various sized dimples on the outer surface of this embodiment is based upon an octahedron. A first edge 3 and a second edge 4 of an octahedral segment extend from the first vertex 6 positioned at a pole of the golf ball to a second vertex 7 and a third vertex 8 positioned near but not intersecting or crossing the parting line 2. A third edge 5 extends from the second vertex 7 to the third vertex 8. Nine dimples are centered along the first edge 3 from the first vertex 6 to the third vertex 8. Nine dimples that correspond in size and position to those of the first edge 3 are spaced along the second edge 4 from the first vertex 6 to the second vertex 7. Nine dimples are also centered along the third edge 5 from the third vertex 8 to the second vertex 7, but are not similarly sized and positioned as those of the first edge 3 and the second edge 4. Each edge has a first through ninth point that corresponds to the point on the edge where each dimple is centered. Thc sizes and spacing for the dimples on each edge are shown in FIG 2. Except for those points that are positioned at vertices, great circles are extended from each point of the first edge 3 to corresponding points of the second edge 4 and the third edge 5. This results in the formation of twenty-one points where great circles intersect. At each of these points of intersection, a dimple is centered as shown in FIG. 2. This results in a dimple pattern having a total of 290 dimples (34 A dimples. 72 B dimples, 88 C dimples, and 96 D dimples that covers more than 65 percent of the golf ball surface.

While various descriptions of the present invention are described above, it should be understood that the various features can be used separately or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope of the present invention are to be included as further embodiments of the present invention.

All patents cited in the foregoing text are expressly incorporated herein by reference in their entirety.

What is claimed is:

1. A method of arranging dimples an a golf ball comprising the steps of:

(a) simulating a polyhedron on an outer surface of the golf ball, wherein the polyhedron comprises a plurality of sides, wherein each side connects at two vertices, and wherein each side comprises a plurality of points;

(b) simulating a plurality of peat circles extending from the plurality of points on each side to the plurality of points on each remaining side;

(c) calculating a plurality of intersection points, wherein each intersection point is defined by Θ and Φ, and wherein Θ and Φ are obtained by simultaneously solving the equations:

$$\Theta = \frac{\tan^{-1}[\sin(\Theta_1)\sin(\Theta_2)\sin(\Phi_1-\Phi_2)]}{[\cos(\Theta_1)\sin(\Theta_2)\sin(\Phi_1-\Phi_2)-\sin(\Theta_1)\cos(\Theta_2)\sin(\Phi_1-\Phi_2)]}$$

$$\Theta = \frac{\tan^{-1}[\sin(\Theta_3)\sin(\Theta_4)\sin(\Phi_3-\Phi_4)]}{[\cos(\Theta_1)\sin(\Theta_2)\sin(\Phi_1-\Phi_2)-\sin(\Theta_1)\cos(\Theta_2)\sin(\Phi_1-\Phi_2)]};\ \text{and}$$

(d) positioning a dimple at each vertex, at the plurality of points on each side, and at each intersection point.

2. The method of claim 1, wherein the polyhedron is oriented according to a pole and a parting line on the outer surface of the golf ball.

3. The method of claim 1, wherein the polyhedron is an octahedron.

4. The method of claim 1, wherein each side comprises at least nine dimples.

5. The method of claim 1, wherein the dimples at the vertex are smaller than the dimples in the center of each side.

6. The method of claim 1, wherein the at least nine dimples have at least four different diameters.

7. The method of claim 6, wherein the at least four different diameters are from about 0.10 inches to about 0.18 inches.

8. The method of claim 1, wherein the plurality of points on each side of the simulated polyhedron is an odd number.

9. The method of claim 1, wherein the dimples positioned at each vertex do not intersect or cross a parting line.

10. The method of claim 1, wherein the dimples positioned at each vertex, plurality of points on each side, and intersection points do not intersect or cross a parting line.

* * * * *